United States Patent [19]

Kallioinen et al.

[11] Patent Number: 4,624,777

[45] Date of Patent: Nov. 25, 1986

[54] FLOTATION MACHINE

[75] Inventors: Jouko O. Kallioinen; Tauno J. Vähäsarja; Arvo Repo, all of Outokumpu, Finland

[73] Assignee: Outokumpu Oy, Espoo, Finland

[21] Appl. No.: 671,671

[22] Filed: Nov. 15, 1984

[30] Foreign Application Priority Data

Nov. 18, 1983 [FI] Finland ..... 834245

[51] Int. Cl.[4] ..... B03D 1/16; B03D 1/20; B03D 1/24

[52] U.S. Cl. ..... 209/170; 209/169; 210/221.1; 210/221.2; 261/87

[58] Field of Search ..... 209/170, 168, 169; 261/87; 210/221.1, 221.2, 703

[56] References Cited

U.S. PATENT DOCUMENTS

| | | | |
|---|---|---|---|
| Re. 25,774 | 5/1965 | Hukki | 209/169 X |
| 1,084,210 | 1/1914 | Howard | 209/169 X |
| 3,307,697 | 3/1967 | Fahlstrom et al. | 209/170 X |
| 3,452,870 | 7/1969 | Katsuta et al. | 209/170 X |
| 3,747,757 | 7/1973 | Kalthoff et al. | 209/170 X |
| 4,247,391 | 1/1981 | Lloyd | 209/168 X |
| 4,425,232 | 1/1984 | Lawrence et al. | 210/221.1 X |

*Primary Examiner*—S. Leon Bashore
*Assistant Examiner*—Thomas M. Lithgow
*Attorney, Agent, or Firm*—Dellett, Smith-Hill and Bedell

[57] ABSTRACT

The invention relates to a flotation machine designed for floating minerals from sludges containing coarse particles. The flotation machine comprises a rotor (3) and a stator (2) provided with actuator machinery and auxiliary equipment (7, 8, 9). The bottom (14) of the stator (2) is solid and the stator-rotor mechanism is located within the cell apart from the cell bottom (10). The feed inlet pipe (12) is connected to the cell so that the feed is directed towards the mixing zone of the rotor flow.

10 Claims, 2 Drawing Figures

FLOTATION MACHINE

The present invention relates to a flotation machine for floating minerals or equivalent from sludges containing coarse particles. The flotation machine consists of a flotation cell and a mixer arrangement fitted therein, the mixer comprising a stator-rotor combination provided with actuator machinery and air inlet equipment.

Flotation cells provided with a stator-rotor mechanism are as such known in the prior art. One example of a well-known cell of this type is the Denver unit flotation cell, which is described in Mineraalien hienonnus ja rikastus (Comminution and Concentration of Minerals) by R. T. Hukki, Keuruu 1964, p. 391–393. According to the said publication, the Denver unit flotation cell can also be used as a coarse flotation cell. In that case the cell is placed in between the mill and the classifier.

The Denver unit flotation cell comprises a cuboid tank which is open at the top; the mixer arrangement is fitted in the said tank. The feed pipe enters the bottom part of the cell so that the feed mixture is directed on top of the mixer. The discharge pipe and the liquid level regulation system are located opposite to the feed pipe on the other wall of the cell. At the bottom of the cell there is formed a small cone, which can also be employed for removing coarse grains.

An apparatus according to the above description has been tested in the plants of the applicant's assignee. Several drawbacks were discovered, among others the following. The apparatus is highly susceptible to blocking. Moreover, it seems that the mechanism wears extremely quickly. The reasons for the latter drawback may be found in the material infeed and partly in the mechanism itself. Furthermore, observations have proved that the thickness of the froth bedding is insufficient, or it may be totally non-existent. Consequently, the possibility of recovering any concentrate over the discharge lip is uncertain. On the other hand, the apparatus produces flotation sludge over the discharge lip.

The flotation machine of the present invention has been invented in order to eliminate, among others, the above mentioned drawbacks.

Among the advantages of the present invention can be stated the following:

The apparatus can treat feed mixtures with remarkably high pulp densities. By means of the apparatus of the present invention, such overcoarse particles that do not in any case remain in suspension can be quickly separated from the feed sludge. Owing to the special structure of the apparatus, the coarse product can be rapidly removed. Thus the circulation of the coarse product within the cell and can be avoided, and simultaneously the degree of wearing is substantially decreased.

BRIEF DESCRIPTION OF THE DRAWING

The invention is described below in more detail with reference to the appended drawings, in which.

DESCRIPTION OF THE PREFERRED EMBODIMENT

Figure 1:
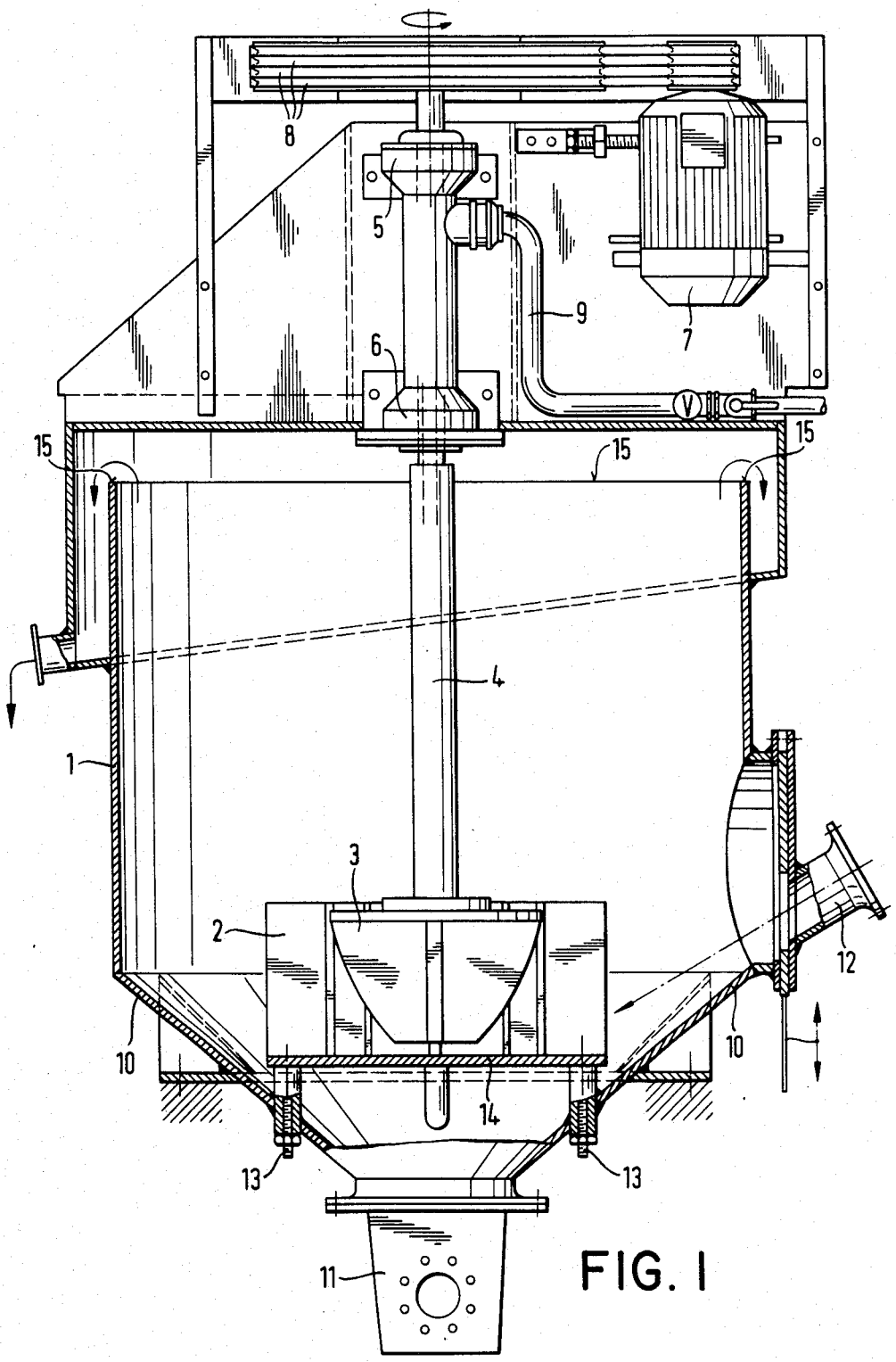
FIG. 1 is an illustration of one preferred embodiment of the invention seen in side view cross-section.

As shown in FIG. 1, inside the flotation cell 1 there is fitted the mixer arrangement comprising the stator 2 and the rotor 3. The rotor is fixed to a hollow axis 4, which is attached with the bearings 5, 6 onto the supporting structures of the cell. The electric engine 7 rotates the axis 4 by means of the cone belts 8. Air is conducted into the rotor 3 through the hollow axis 4 The air inlet pipe is marked with the reference number 9.

Figure 2:
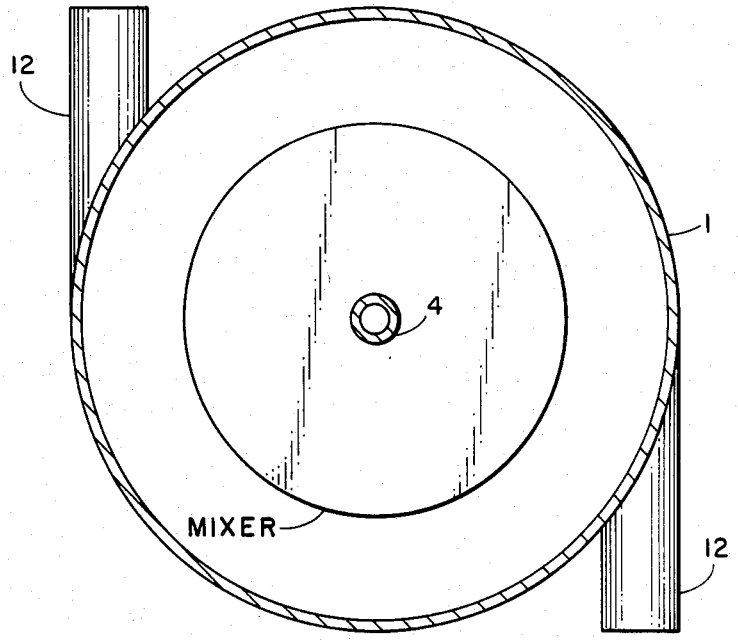
FIG. 2 is a horizontal sectional view of a second embodiment of the invention.

The whole bottom of the cell has been designed to form a cone 10. At the bottom of the cone, there is made an aperture provided with a pipe connection 11, through which pipe the waste is discharged from the cell. The feed inlet pipe 12 is arranged relative to the bottom of the cell in such a fashion that the feed sludge entering through the pipe is conducted directly to the washing range of the propeller stream flowing from between the blades of the stator 2. An advantageous additional effect is created if the feed inlet pipe is adjusted in a slanted or even entirely tangential position onto the wall of the round cell as shown in FIG. 2. Several feed inlet pipes may be provided as also shown in FIG. 2.

The position of the inlet pipe 12 can be adjusted in the vertical direction. Experience shows that the possibility for adjusting the pipe 12 is important if an optimal operation is desired with various different types of concentrates.

The stator 2 is attached by means of bolts 13 onto the bottom of the cell so that in between the cell bottom and the stator bottom there remains a clear cross-gap, which in practice means several centimeters. The stator 2 is provided with a bottom 14. While the feed flows against the stream flowing from the rotor and the stator, the coarse particles are classified so that the light floatable particles are suspended, whereas the coarser and heavier particles sink directly down to the bottom of the cell. Because the stator is located apart from the bottom, the coarse material can easily slide down below the stator and further on to be discharged through the pipe 11. The bottom 14 attached under the stator prevents the coarse particles from rising up due to the rotor suction, and thus it also prevents the useless and wearing circulation of the coarse material within the cell.

The coarse concentrate is discharged from the cell 1 in normal fashion over the discharge lip 15. The recovered repeated coarse concentrate is as such ready to be added to a concentrate recovered from an ordinary flotation process. When desired, the coarse concentrate can naturally also be refloated. The coarse waste removed from the flotation machine is sent to regrinding.

The structures of the rotor and the stator, for instance, have not been explained in detail in the above description. This is due to the fact that the use of the invention is not limited to any specific rotor-stator type alone. Best results in practice are apparently achieved by employing machinery made by Outokumpu Oy and sold under the trade mark OK.

In the above description the invention has been described with reference to only one preferred embodiment. It is naturally clear that the invention can be largely modified within the scope of the following patent claims.

We claim:

1. A flotation machine for separating coarse particles from sludges, comprising a flotation cell and a mixer, the flotation cell having a side wall, a bottom wall, an outlet connection for withdrawing material containing coarse particles from the cell, said outlet connection being formed in the bottom wall of the cell, and at least one inlet connection for introducing the sludge to be treated, add the mixer including a stator substantially imperforate stator bottom plate and a rotor located above said bottom plate, the mixer being disposed in the flotation cell with the bottom plate spaced from the bottom wall of the cell and located over the outlet connection and being surrounded laterally in the flotation cell by a washing zone that is substantially free of obstruction, the inlet connection of the cell being disposed laterally outwards of the mixer and being arranged so that sludge entering the cell passes laterally towards the mixer, and the machine also comprising means for introducing gas under pressure into the flotation cell at a location that is the vicinity of the mixer.

2. A machine according to claim 1, wherein the bottom wall of the flotation cell converges downwards.

3. A flotation machine according to claim 2, wherein the outlet connection is at the lowermost point of the bottom wall.

4. A flotation machine according to claim 1, wherein the flotation cell is circular in cross-section and the inlet connection is connected to the flotation cell in an orientation that is tangential with respect to said circular cross-section.

5. A flotation machine according to claim 1, comprising a plurality of inlet connections.

6. A flotation machine according to claim 1, wherein the inlet connection is attached to the flotation cell by means permitting vertical adjustment of the inlet connection.

7. A flotation machine according to claim 1, comprising a rotor shaft that is disposed on a substantially vertical axis and is connected to the rotor, and wherein the bottom wall of the flotation cell converges downwards towards said vertical axis, the outlet connection is disposed substantially on said vertical axis, and the inlet connection is disposed at substantially the same height as the rotor.

8. A flotation machine according to claim 7, wherein the side wall of the flotation cell is substantially veritcal and the inlet connection is disposed at the bottom of the side wall.

9. A flotation machine according to claim 1, wherein the side wall is substantially vertical and the bottom wall converges downwards, and the mixer is disposed at least partially within a space that is bounded laterally by the bottom wall.

10. A flotation machine according to claim 9, wherein the inlet connection is disposed at substantially the same height as the rotor.

* * * * *